United States Patent [19]

Gestetner

[11] 4,319,681

[45] Mar. 16, 1982

[54] CONTAINER HOLDER AND METHOD OF PACKAGING

[76] Inventor: Arthur Gestetner, 1750, 58th St., Brooklyn, N.Y. 11204

[21] Appl. No.: 144,567

[22] Filed: Apr. 28, 1980

[51] Int. Cl.[3] ..... B65D 85/42

[52] U.S. Cl. ..... 206/45.19; 206/486

[58] Field of Search ..... 206/45.19, 486, 562

[56] References Cited

U.S. PATENT DOCUMENTS

| | | | |
|---|---|---|---|
| 806,819 | 12/1905 | Mattson | 211/74 |
| 809,854 | 1/1906 | Sochurek | 220/21 |
| 878,233 | 2/1908 | Paulson | 211/74 |
| 1,088,642 | 2/1914 | Wilcox | 211/74 |
| 1,557,598 | 10/1925 | Luly et al. | 211/74 |
| 2,672,980 | 3/1954 | Halbach | 206/486 X |
| 3,108,731 | 10/1963 | Royce | 206/45.19 X |
| 3,193,107 | 7/1965 | Pilat | 211/74 |
| 4,088,225 | 5/1978 | Hartnell | 206/45.19 X |

*Primary Examiner*—Steven M. Pollard
*Attorney, Agent, or Firm*—Brumbaugh, Graves, Donohue & Raymond

[57] ABSTRACT

A holder securing a bottle or other container releasably in a package. The holder has a raised platform with an opening therein conforming to the shape of the bottle at its lower portion. The sides of the opening engage the bottle in an interference or friction fit. Preferably, at the height of the opening, the bottle sides slope downwardly and outwardly. A base extends across the bottom of the platform supporting the bottom of the bottle. The base can be a part of the outer package, preferably a transparent box, folded around the holder and the bottle. The method of packaging the bottle, using the holder, includes placing the holder over the bottle, forcing the holder downward toward the bottom of the bottle, and affixing the base to the holder with the bottle bottom resting on the base.

6 Claims, 2 Drawing Figures

CONTAINER HOLDER AND METHOD OF PACKAGING

BACKGROUND OF THE INVENTION

This invention relates to a retainer or holder that secures a container in place, for example in a package, and to a method of packaging that uses the container holder. The holder is particularly useful for securing containers near their bottom in display packaging.

Previously, a bottle holder similar in appearance to that of this invention was known for securing a perfume bottle within a transparent package. The bottle holder had a peripheral flange affixed, by staplin for example, to the bottom of a transparent box, and a central, raised platform-like section to which the bottle was affixed. A raised ridge surrounded the bottom of the bottle, and a slight reduction in the height of the ridge at one location permitted a better indication of the volume that the bottle contained. The prior art bottle holder relied on glue, however.

In the prior art device, the ridge that located the bottle bottom in place surrounded an inner, planar bottom surface. The surface was a part of the same sheet plastic that formed the remainder of the holder. To this the bottle bottom was glued.

This prior art approach had several major disadvantages. To begin with, it was difficult to remove the bottle from the holder. Once removed, there would be a mass of glue, or worse still, a mass of glue and a torn away segment of the sheet plastic holder remaining on the bottom of the bottle. In the case of a perfume bottle to be placed on a dressing table, for example, the remains of the glue and packaging would need to be carefully picked or scraped away, or it would remain to detract from the desired aesthetic appearance. In either case, subsequent sales of an otherwise attractive product could suffer.

SUMMARY OF THE INVENTION

In accordance with the invention, a holder and method for its use are provided that have all of the desirable features of the aforementioned prior art holders and none of the disadvantages.

The holder according to this invention uses no glue whatsoever to retain the bottle or other container. The holder includes a raised platform section with an opening therethrough of a size to form a frictional or interference fit with the outer surface of the container where the container passes through the opening. The container bottom rests on a base, not on a part of the sheet of the holder, and this base can be a portion of a transparent box folded about the container to permit the container's being visible as packaged.

In the packaging method that uses the holder according to the invention, the holder is placed over the top of a bottle and forced downwardly until the edges of the opening therethrough fit tightly and securely about the outer surface of the container. The container bottom and holder are positioned on the base, and the base is secured to the holder about, for example, a peripheral flange.

In a preferred embodiment of this invention, a particular bottle used with this invention has a lower portion with downwardly and outwardly sloping sides. The sides wedge into tight frictional engagement with the perimeter of the opening when the holder is placed over the top of the bottle and moved down to its proper location near the bottom of the bottle. Below the opening, the larger bottom of the bottle is trapped between the holder and the base.

The holder can be formed, by the application of heat and pressure, as is known, from thin sheet plastic to include an upstanding ridge about the location where the container or bottle is to be secured. To assure that the bottle cannot too easily be dislodged, the sheet plastic of the holder should be relatively nondeformable under tension so as not to stretch and release the bottle under normal handling of the package containing the holder and the bottle. A fairly stiff, hard plastic sheet is therefore preferred. The ridge formed in the sheet preferably has inward, downwardly projecting walls forming the sides of the opening that receives the bottle. This can afford a slight resilience to the sides of the opening, by which resilience, the opening sides or edges are moved slightly outward as the bottle is wedged into place. The downwardly extending walls, then, engage the bottle in a tight fit.

The method of packaging according to the invention, it will be seen, affords a simple and quick manner of securing a bottle or other container in a package. The method is entirely free of glue, and thus it avoids the careful application of glue and any need for glue setting time.

The resulting package, on the other hand, totally avoids the aforementioned adherence of an unslightly glue mass and portion of plastic sheet to the bottom of the bottle. The bottle is, nevertheless, securely held in place. The ridge about the bottom of the bottle can be provided with the desired reduction in height to indicate the bottle's content, and the bottle is easily removed simply by forcing its bottom up and out from under the retaining opening edges of the holder.

The above and further advantages of the invention will be better understood from the following detailed description of a preferred embodiment taken in consideration with the several figures of the attached drawings.

DETAILED DESCRIPTION OF THE PREFERRED EMBODIMENT

Figure 1:
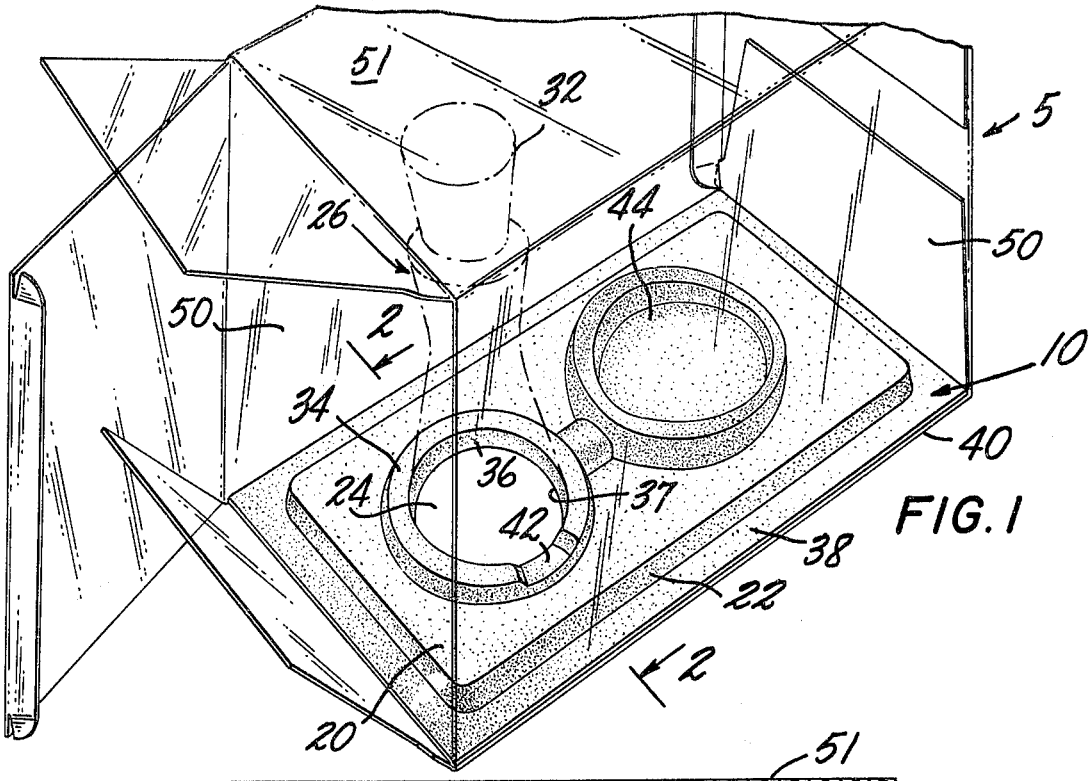
FIG. 1 is a fragmentary perspective view showing a transparent package in the form of a box, with a holder according to the invention disposed at the bottom thereof.
Figure 2:
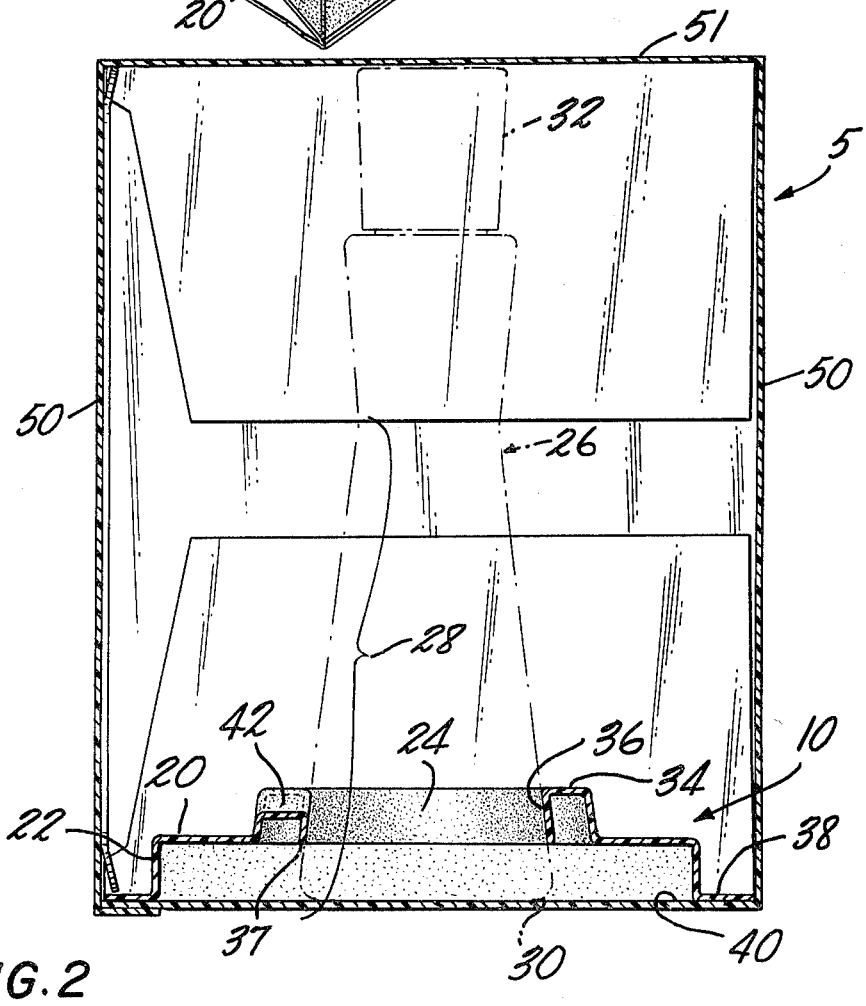
FIG. 2 is a cross-sectional view along the line 2—2 of FIG. 1 and better illustrates the relationship of the holder and a retained bottle.

In FIGS. 1 and 2, a package 5 is a transparent box of thin, plastic sheet forming sides 50, a top 51, and a base 40. A bottle retainer or holder 10 resides in the bottom of the package 5. The holder, which is of thin, formed plastic sheet, has a raised central portion or platform 20 supported above the base 40 by upwardly standing sides 22. A peripheral flange 38 adjoins the sides 22, extends outwardly to the edges of the base 40, and is affixed to the base 40 by suitable means, such as staples or the like.

In both FIG. 1 and FIG. 2 a bottle 26 is shown in phantom outline indicating the location at which a bottle is to be secured by the holder 10 and the base 40 of the package 5. An annular ridge 34 defines the bottle location, surrounding an opening 24 through which the bottle extends. The ridge 34 has a downward inner wall 36 that provides the internal surface of the opening 24 and terminates at an edge 37.

For marketing purposes, it is important that the consumer be able to see as much of the product as possible. Towards that end, it is customary to provide a depression 42 on the annular ridge 34. This small depression 42 permits the consumer to see that the bottle 26 extends below the top of the annular ridge 34 and that the volume or quantity of the product is greater than that visible only to the top of the ridge.

The raised platform can locate for display one or more additional items besides the bottle 26. For this purpose, a receptacle 44 can be molded integrally with the platform for mounting of novelty items, toys, dolls, or other inducements to buy, for example. Alternatively, additional openings like the opening 24 may be provided for securing and displaying more than one bottle.

Preferably, the bottle 26 has a lower portion proximate the opening 24 that slopes outwardly and downwardly so that the bottle bottom 30 is trapped between the base 40 and the holder opening 24. In a bottle like that illustrated in FIG. 2, for example, the sloping sides and enlarged bottom are conveniently and attractively provided by a long lower bottle portion 28 that gradually and downwardly increases in cross section.

In use, the holder 10 can be placed over the top 32 of the bottle 26, while the bottle bottom 30 is resting on the base 40. The holder is forced down around the bottle. The edges 37 and the opening 24 are spread slightly as the bottle wedges into the opening. The walls 36 of the opening frictionally engage the lower bottle exterior in tight engagement. The peripheral flange 38 of the holder can then be properly aligned on the base 40, stapled thereto, and the sides 50 and top 51 of the package 5 can be folded up and around the bottle and the box ends closed. No glue has been used to secure the bottle. The bottle can be pulled loose from its resting place, although under ordinary handling, the bottle should not dislodge.

While a preferred embodiment of the invention has been described, it will be readily apparent to those skilled in the art that modifications may be made in the preferred embodiment without departure from the spirit and scope of the invention as set forth in the appended claims.

I claim:

1. A holder for securing a container releasably in a package including:

a section of sheet material;

a raised area of the section of sheet material;

the raised area defining an opening therethrough having a size dimensioned to engage tightly about a bottom portion of the container; and a base member beneath the section of sheet material having an area thereof located closely below the opening through the raised portion for engaging and supporting the bottom of the container, wherein:

the sheet material is a formed plastic sheet;

the sheet has an outwardly extending peripheral flange secured to the base member, upwardly extending wall inward of the flange, and the walls terminating upwardly in a platform that is the raised area of the section of sheet material;

said opening being formed through the platform and having a downwardly projecting wall to provide an inside surface of the opening greater than the thickness of the sheet and for releasably holding the container in a friction fit therein.

2. The holder according to claim 1, wherein:

the sheet further comprises a raised ridge formed therein and projecting upwardly above the plane of the platform about the opening to form a receptacle for the container; and said downwardly projecting wall extending downwardly from the ridge to secure the container in the receptacle free of glue or any other retaining means.

3. The holder according to claim 2 in combination with the container, wherein:

the container is a bottle having a lower portion with downward and outward sloping sides;

said downwardly projecting wall terminates in a free end resiliently movable outwardly by engagement with said sides of the bottle to form a tight interference fit, with the bottle sides and the downwardly projecting wall engaging.

4. The holder according to claim 1 or 2, in combination with the container, wherein:

the container has an exterior portion frictionally engaging the inside surface of the opening, and the bottom of the container rests on the base member.

5. The combination according to claim 4, wherein:

the container has an outside surface on the lower portion sloping outwardly and downwardly;

said surface engages the inside surface of the opening; and below the opening said container has a width larger than the width of the opening.

6. A method of packaging a container including:

providing a plastic sheet in the shape of a holder having a raised platform section and forming a ridge on the platform to define a location for the container;

defining an opening into the raised platform section by removing a central portion of the location defined by the ridge to form an inner edge on a wall extending downwardly from the ridge;

placing the holder over the top of a container having a lower portion with walls of a dimension to frictionally, tightly engage about the interior of the opening;

forcing the holder downward on the container into tight engagement near the container bottom by forcing the inner edge downwardly and outwardly along a lower container portion that has a downward and outward sloping surface to bring the inner surface of the wall extending downwardly from the ridge into tightly gripping engagement on the container exterior;

placing the bottom of the container on a base; and securing the base to the holder;

* * * * *